US009452912B1

(12) United States Patent
Bergeron

(10) Patent No.: US 9,452,912 B1
(45) Date of Patent: Sep. 27, 2016

(54) HYDRAULIC POWER BUCKET

(71) Applicant: Raymond Bergeron, Trenton, MI (US)

(72) Inventor: Raymond Bergeron, Trenton, MI (US)

( * ) Notice: Subject to any disclaimer, the term of this patent is extended or adjusted under 35 U.S.C. 154(b) by 0 days.

(21) Appl. No.: 14/671,285

(22) Filed: Mar. 27, 2015

(51) Int. Cl.
*B66C 3/02* (2006.01)
*E02F 3/413* (2006.01)

(52) U.S. Cl.
CPC *B66C 3/02* (2013.01); *E02F 3/413* (2013.01)

(58) Field of Classification Search
CPC ..... E02F 3/404; E02F 3/4131; E02F 3/413; E02F 3/4136; E02F 5/285; E02F 7/005; B66C 3/08; B66C 3/12; B66C 3/02
USPC ..... 37/461, 184–188; 414/697, 726, 739
See application file for complete search history.

(56) References Cited

U.S. PATENT DOCUMENTS 1,218,921 A * 3/1917 Barnard ..... B66C 3/12 37/186
1,353,651 A * 9/1920 Barnard ..... B66C 3/08 37/186
3,299,548 A * 1/1967 Freyer ..... B66C 3/02 37/184
3,737,059 A * 6/1973 Peterson ..... E02F 3/404 37/184
4,327,943 A * 5/1982 Longo ..... E02F 3/413 294/68.23
4,882,859 A * 11/1989 Bollinger ..... B66C 3/16 37/187
5,473,828 A * 12/1995 Kishi ..... B66C 3/16 294/68.23
5,561,922 A * 10/1996 Lynch ..... E02F 3/4131 37/317

* cited by examiner

*Primary Examiner* — Robert Pezzuto
(74) *Attorney, Agent, or Firm* — Dinsmore & Shohl LLP; Douglas W. Sprinkle

(57) ABSTRACT

A power bucket having a first and second swing arm, each having two ends. The first end of each swing arm are pivotally secured together. A first bucket half is then pivotally secured to the other end of the swing arm and, likewise, a second bucket half is pivotally mounted to the second swing arm and the bucket halves are in turn pivotally secured together. A first and second hydraulic actuator are operatively connected between the first swing arm and the first bucket half and the second swing arm and the second bucket half, respectively. The hydraulic rods for the actuators are movable between a retracted position in which the bucket is open, and an extended position in which the bucket is closed.

12 Claims, 5 Drawing Sheets

HYDRAULIC POWER BUCKET

BACKGROUND OF THE INVENTION

I. Field of the Invention

The present invention relates generally to power buckets and, more particularly, to a hydraulic actuated power bucket.

II. Description of Related Art

There are many previously known power buckets that are used in a number of applications, such as loading and unloading cargo, underwater dredging, and the like. These previously known power buckets typically comprise two bucket halves that are pivotally mounted together. Each bucket half includes a cutting edge so that the cutting edges are generally parallel to each other.

The bucket halves are movable between an open and a closed position. In the open position, the cutting edges are spaced apart from each other and the bucket halves are pivoted outwardly from each other. When the bucket is moved to a closed position, the bucket halves pivot toward each other thus engulfing the load in between the two bucket halves.

Bucket halves are typically suspended either by a cable or by an excavator stick so that the power bucket is positioned above the load or area to be dredged. Many of the previously known power buckets utilize a plurality of pulleys mounted to the power bucket and which cooperate with a closure line controlled by the operator of the power bucket. Typically, with the power bucket in an open position, the power bucket is closed by pulling the closure line upwardly from the power bucket which causes the power bucket halves to pivot towards each other in the desired fashion.

There have, however, been previously known power buckets which utilized hydraulic actuators to move the power bucket between an open and a closed position. These previously known hydraulic power buckets typically disposed one or more hydraulic cylinders in vertical alignment with the power bucket. The actuation of the hydraulic cylinder would then simulate the movement of the previously known closure line used with power buckets.

These previously known hydraulic power buckets, however, all suffered from a number of common disadvantages. First, for large buckets, e.g. 10 cubic yards or more, it was necessary to use massive hydraulic cylinders to provide sufficient power to close the bucket halves from an open position. Such massive hydraulic cylinders, however, are expensive to manufacture or purchase.

A still further disadvantage of these previously known hydraulic power buckets is that massive hydraulic pumps are required to provide sufficient power to the hydraulic cylinders to open and close the bucket halves. These massive hydraulic pumps are also expensive to obtain and maintain.

A still further disadvantage of these previously known hydraulic power buckets is that the cycle time for closing the power bucket is relatively slow. The relatively slow cycle time for these prior hydraulic power buckets is due primarily to the need to pump hydraulic fluid under high pressure from the compressor and to the hydraulic actuators.

A still further disadvantage of these previously known hydraulic power buckets is that the cutting edges of the power bucket halves vertically dig into the load as the power bucket moves from its open and to its closed position. Typically, the vertical downward displacement of the cutting edges during closing movement of the power bucket exceeds several feet.

While a vertical displacement of the cutting edges of the bucket halves of several feet may be perfectly acceptable for certain operations, such as unloading grain or coal, in other operations it is not. For example, during a dredging operation to remove contaminants from a water bed, it is often desirable to only remove a few inches of the water bed as the power bucket is moved from its open and to its closed position. By removing only a few inches of the water bed during the closure of the power bucket, contaminants on top of the water bed are efficiently removed without removing excessive amounts of the water bed which is uncontaminated. This is particularly important since dump sites which will accept contaminated soil often charge on a volume basis. Consequently, the removal of an excess of uncontaminated waterway escalates the disposal cost of the contaminated material.

SUMMARY OF THE PRESENT INVENTION

The present invention provides a power bucket which overcomes the above mentioned disadvantages of the previously known power buckets.

In brief, the power bucket of the present invention comprises a first and second swing arm that are pivotally secured together at one end. A first bucket half is pivotally secured to the other end of the first swing arm while a second bucket half is pivotally secured to the other end of the second swing arm.

A first hydraulic actuator is operatively coupled between the first swing arm and the first bucket half on an outside surface. Similarly, a second hydraulic actuator is operatively connected between the second swing arm and the second bucket half on its outside surface.

Extension of the hydraulic cylinders by connection of the hydraulic cylinders with a source of hydraulic pressure pivots the bucket halves from an open and to a closed position. Conversely, retraction of the hydraulic actuators moves the bucket halves between a closed and to an open position.

In order to reduce the size of hydraulic pump necessary to power the power bucket actuators, a pressure accumulator is preferably mounted on one of the bucket halves. This pressure accumulator is fluidly connected to the output from a relatively small hydraulic pump. In practice, the hydraulic pump continuously provides pressure to the accumulator during those cycle periods when neither opening nor closure of the bucket halves is required. In this fashion, the accumulator is capable of accumulating sufficient pressure to either open or close the power bucket when required.

BRIEF DESCRIPTION OF THE DRAWING

A better understanding of the present invention will be had upon reference to the following detailed description when read in conjunction with the accompanying drawing, wherein like reference characters refer to like parts throughout the several views, and in which.

DETAILED DESCRIPTION OF PREFERRED EMBODIMENTS OF THE PRESENT INVENTION

Figure 1:
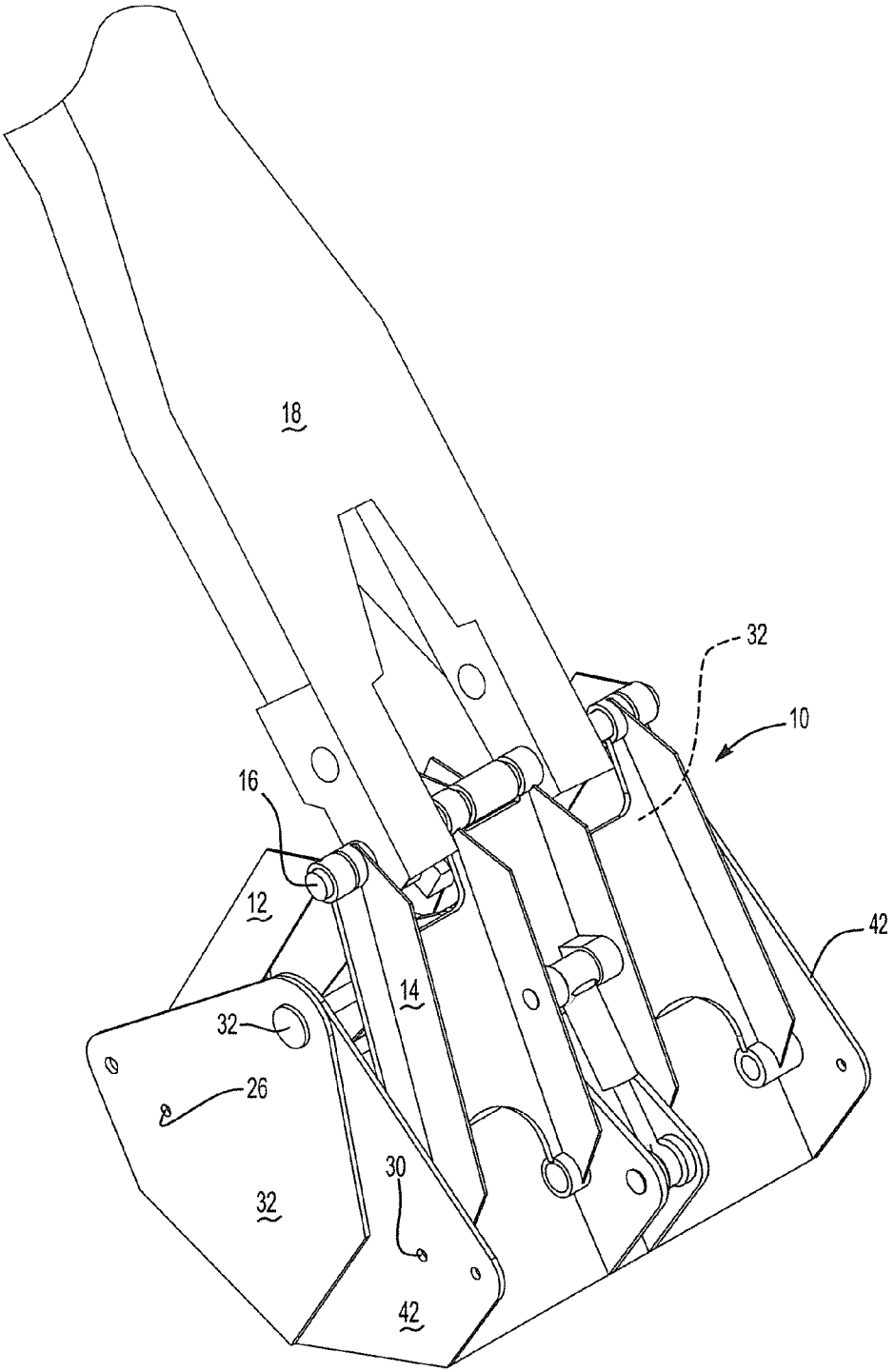
FIG. 1 is a perspective view illustrating a preferred embodiment of the present invention.
Figure 2:
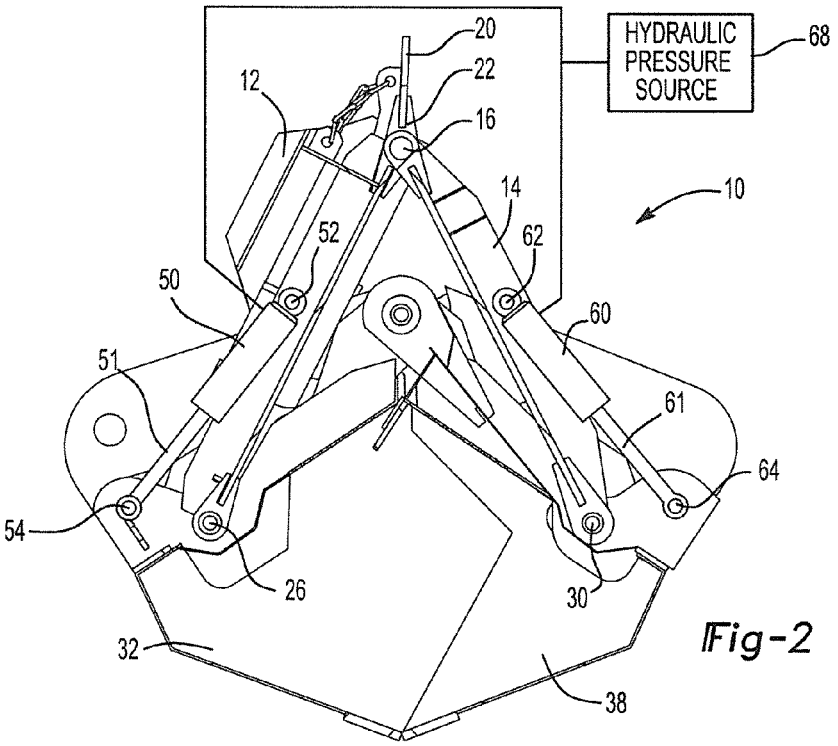
FIG. 2 is a side view of the preferred embodiment of the present invention with the bucket halves in a closed position.
Figure 3:
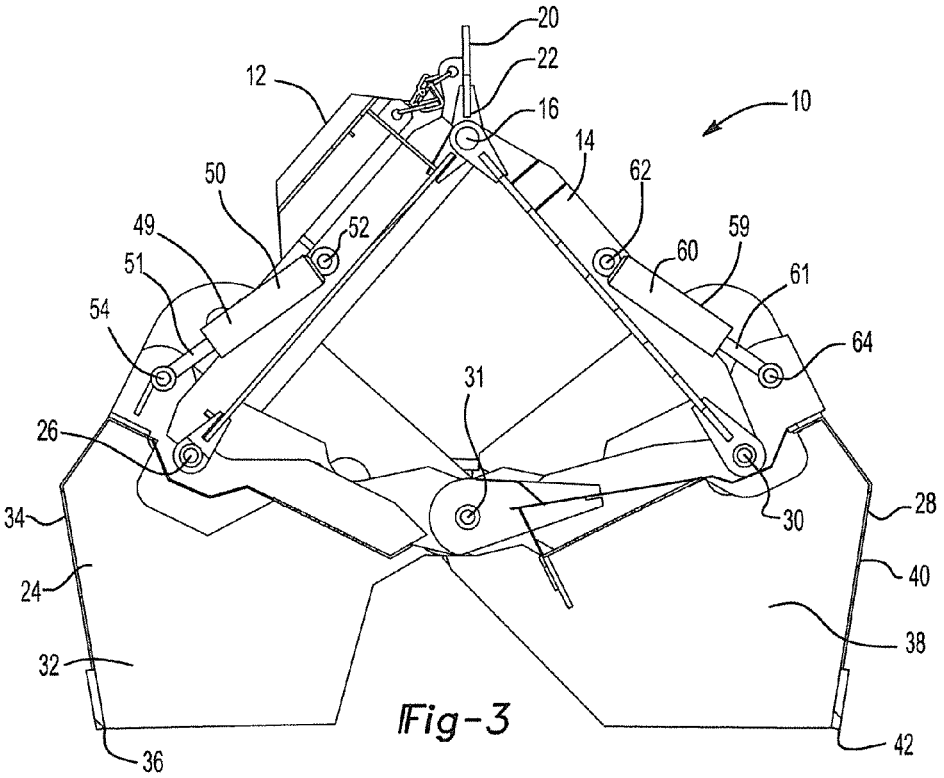
FIG. 3 is a side view similar to FIG. 2, but illustrating the bucket halves in an open position.

With reference first to FIGS. 1-3, a preferred embodiment of a power bucket 10 according to the present invention is shown. The power bucket 10 includes a first swing arm 12 and a second swing arm 14 which are pivotally secured together at one end by a pivot pin 16. The pivot pin 16 thus enables the swing arms 12 and 14 to pivot between a closed position, illustrated in FIG. 2, and an open position, illustrated in FIG. 3.

The bucket 10 is illustrated in FIG. 1 as being suspended by an excavator stick 18. In the conventional fashion, the excavator stick 18 is pivotally mounted to the pivot pin 16.

Alternatively, however, the bucket 10 may be suspended by a cable 20 (FIGS. 2 and 3) secured to an adaptor 22 pivotally mounted to the pivot pin 16. Furthermore, still other ways may be used to suspend the power bucket 10 without deviation from the spirit or scope of the invention.

Still referring to FIGS. 1-3, a first bucket half 24 is pivotally mounted by a pivot pin 26 to the other or lower end of the first swing arm 12. Similarly, a second bucket half 28 is pivotally mounted by a pivot pin 30 to the other or lower end of the second swing arm 14. The bucket halves 24 and 28, in turn, are pivotally mounted together by a pivot pin 31.

The first bucket half 24 includes a pair of sidewalls 32 that are spaced apart from each other as well as an end wall 34 so that the sidewalls 32 and end wall 34 form a scoop chamber for the first bucket half. A cutting edge 36 extends between the sidewalls 32. Similarly, the second bucket half 28 also includes a pair of spaced apart sidewalls 38 and end wall 40 which, together, form a scoop chamber for the second bucket half 28. A cutting edge 42 extends between the sidewalls 38 along one edge of the end wall 40.

As best shown in FIGS. 2 and 3, in order to move the power bucket halves between an open position (FIG. 3) and a closed position (FIG. 2), a first hydraulic actuator 50 has one end 52 of a hydraulic cylinder 49 pivotally connected to the first swing arm 12 and a second end 54 on a hydraulic rod 51 pivotally connected to the first bucket half 32 at a position spaced radially outwardly from the pivot pin 26 between the swing arm 12 and the first bucket half 32 when the bucket halves 32 and 38 are in their closed position.

Similarly, a second hydraulic actuator 60 has one end 59 of a hydraulic cylinder 61 pivotally connected by a pivot pin 62 to the second swing arm 14. The opposite end of a hydraulic rod 61 of the hydraulic actuator 60 is pivotally connected by a pivot pin 64 on the outer surface of the second bucket half 38 at a position spaced outwardly from the pivot pin 30 connecting the swing arm 14 to the bucket half 38.

The first hydraulic actuator 50 thus forms one leg of a triangle between the pivot pins 52, 54, and 26. Similarly, the second hydraulic actuator 60 forms one leg of a triangle formed between the pivot pins 62, 64, and 30. Consequently, extension or retraction of the rods 51 and 61 of the hydraulic actuators 50 and 60, respectively, causes the bucket halves 32 and 38 to pivot about their pivot pin 30 by an amount dependent upon the degree of extension or retraction of the hydraulic rods 51 and 61.

More specifically, assuming that the bucket halves 32 and 38 are in their open position as shown in FIG. 3. In this position, the hydraulic rods 51 and 61 are in their retracted position. Actuation of the hydraulic actuators 50 and 60 by connection with a source of a hydraulic pressure 68 causes the hydraulic rods 51 and 61 to move from the retracted to an extended position thus pivoting the bucket halves 24 and 28 to a closed position.

Figure 4C:
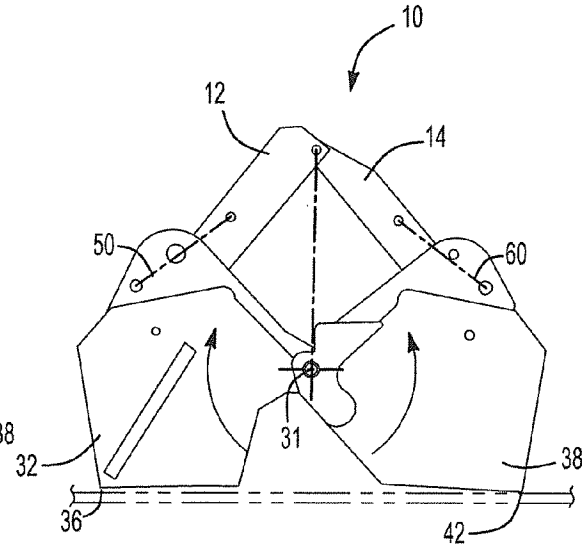
FIGS. 4A-4C are diagrammatic views illustrating the opening and closure of the power bucket.
Figure 4B:
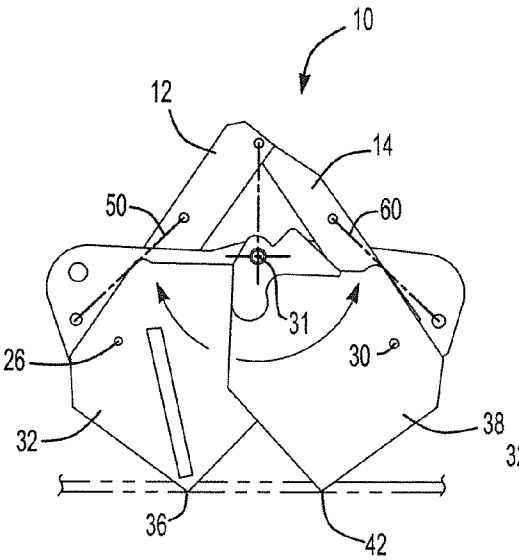
Figure 4A:
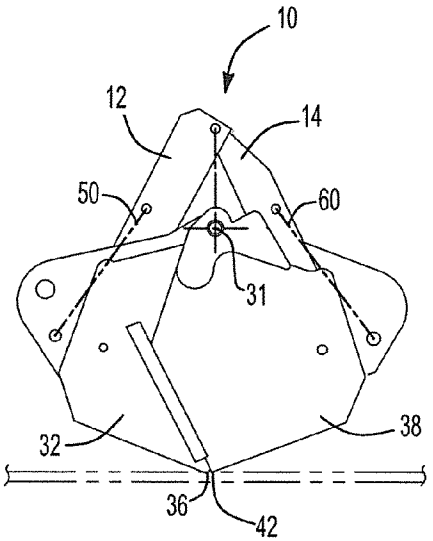

With reference now to FIGS. 4A-4C, movement of the power bucket 10 between its open and closed position is illustrated diagrammatically. In particular, the bucket is illustrated in FIG. 4A as in an open position. In its open position, the cutting edges 36 and 42 of the bucket halves 24 and 28, respectively, are spaced apart in preparation for digging a load. In its open position, the hydraulic rods 51 and 61 are in their retracted position so that the pivot pin 31 connecting the bucket halves 24 and 28 together is in its lowermost position.

Upon actuation of the hydraulic actuators 50 and 60 by selective connection to the source of hydraulic pressure, the bucket halves 24 and 28 move to a partially closed position as shown in FIG. 4. In doing so, the extension of the hydraulic rods 51 and 61 pivots the bucket halves 24 and 28 about their pivot pins 26 and 30 which pivotally connect the bucket halves 32 and 38 to the swing arms 12 and 14, respectively. This pivotal action causes the cutting edges 36 and 42 to pivot downwardly. However, simultaneously the pivot pin 31 connecting the bucket halves 24 and 28 together shifts upwardly so that the vertical displacement of the cutting edges 36 and 42 is only a few inches.

As the hydraulic rods 51 and 61 are moved to their most extended position as shown in FIG. 4, the bucket halves 24 and 28 are moved to their closed position thus entrapping the load in between the bucket halves. However, the further extension of the hydraulic rods 51 and 61 has further shifted the pivot pin 31 between the bucket halves 24 and 28 to its uppermost position while simultaneously pivoting the cutting edges 36 and 42 downwardly.

Consequently, the power bucket 10 of the present invention achieves a substantially level cut, i.e. within a few vertical inches, as the bucket is opened and closed thus making the bucket 10 ideal for dredging waterways to remove contaminated soil on top of the waterways.

Figure 5:
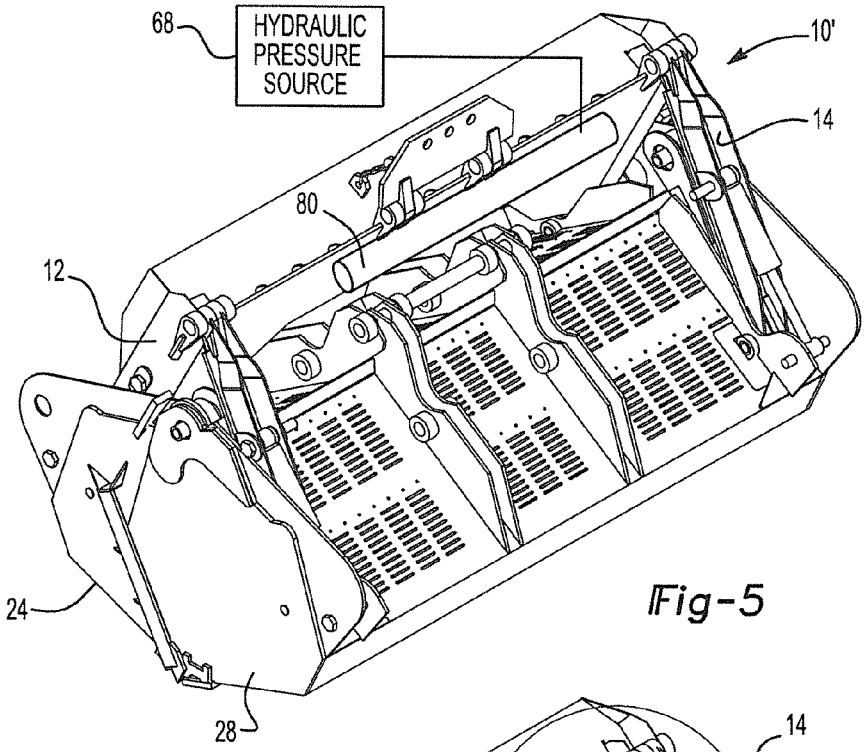
FIG. 5 is an elevational view of a second preferred embodiment of the present invention.
Figure 6:
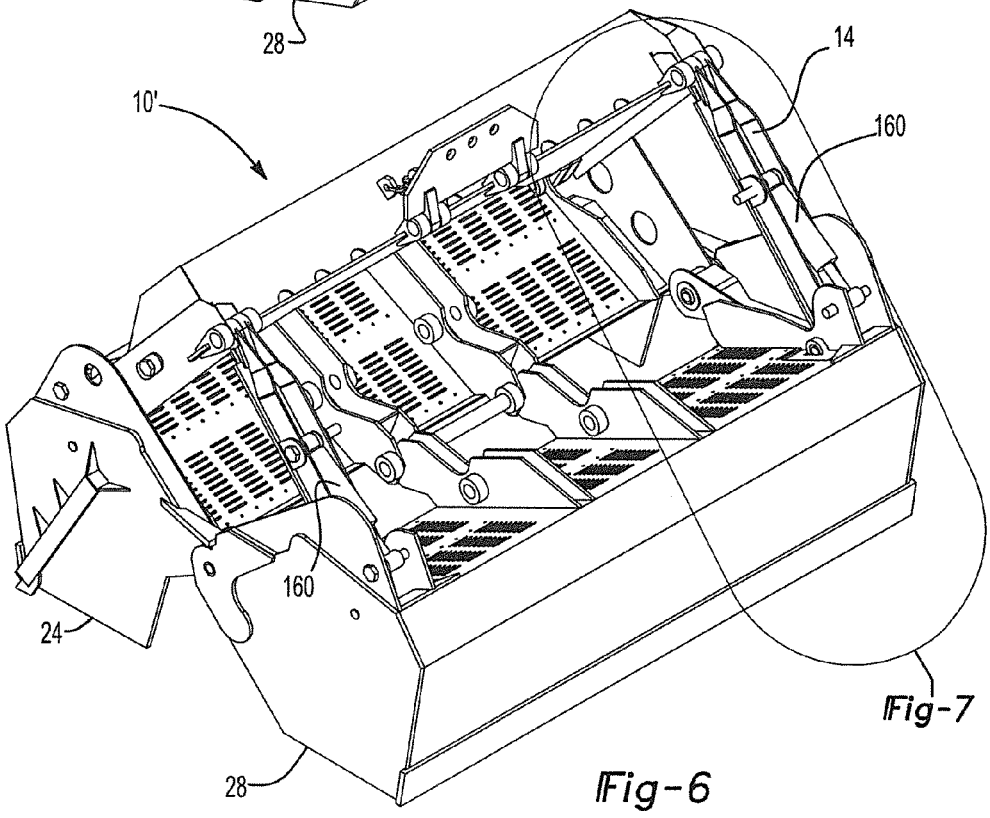
FIG. 6 is a view similar to FIG. 5, but illustrating the bucket in an open position.
Figure 7:
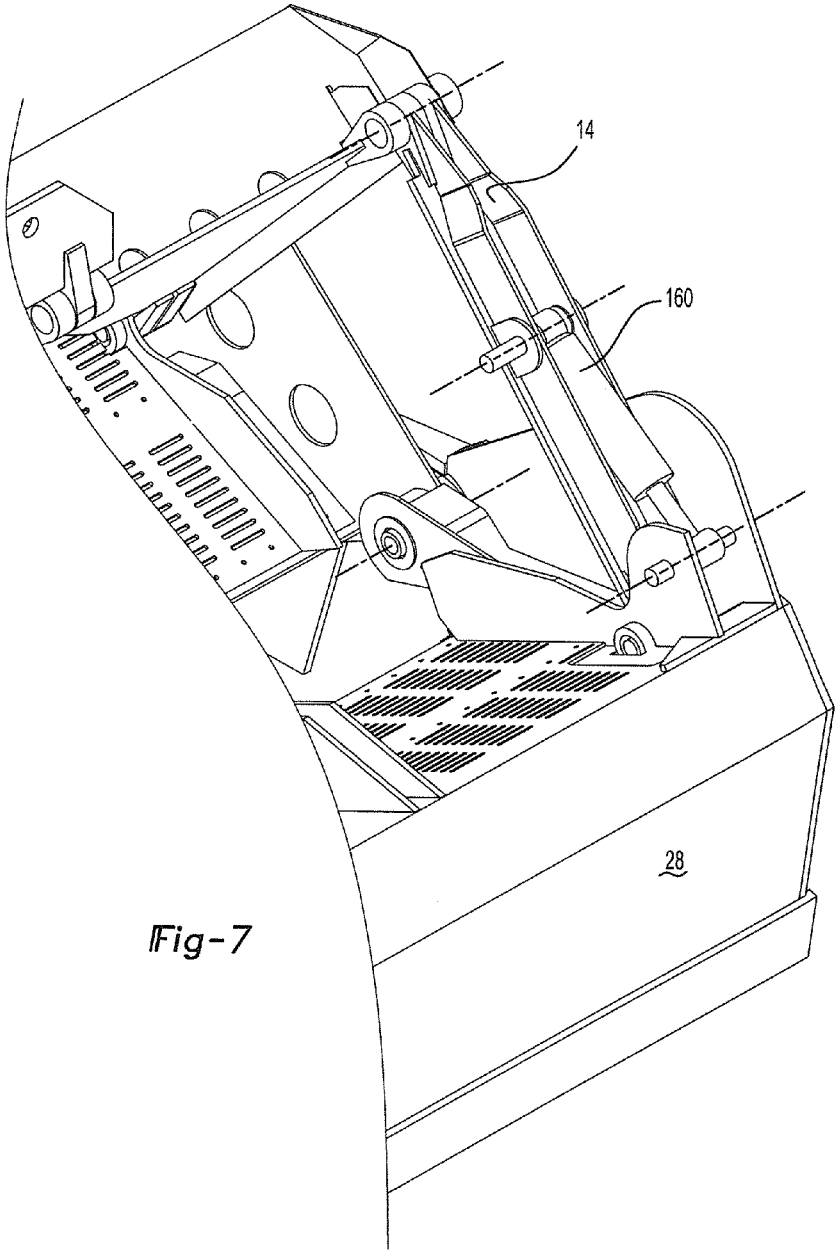
FIG. 7 is a view of circle 7 in FIG. 6 and enlarged for clarity.

With reference now to FIGS. 5-7, a modified power bucket 10' is shown. The power bucket 10' is larger in size than the power bucket 10 illustrated in FIGS. 1-4. However, the power bucket 10' is functionally the same as the power bucket 10 with two exceptions. First, a pair of hydraulic actuators 160 replace the single actuator 60 for the first bucket half 24. Likewise, a pair of hydraulic actuators also replace the single actuator 50 for the second bucket half 28. These additional actuators are necessary due to the increased size of the overall power bucket 10'.

Secondly, the power bucket 10' differs from the power bucket 10 in that the power bucket 10' includes a hydraulic pressure accumulator 80 mounted to one of the swing arms 12 or 14. The pressure accumulator 80 is fluidly coupled to the hydraulic pressure source 68 which preferably includes a small to medium size hydraulic motor. The hydraulic pressure source 68 thus continues to pressurize the accumulator 80 even when the bucket 10' remains in its open or closed position in between actuation cycles. In this way, the accumulator 80 can accumulate sufficient pressure to pivot the power bucket 10' between its open position (FIG. 6) and its closed position (FIG. 5) despite the use of a fairly small hydraulic pump in the hydraulic pressure source 68. The actual size of the accumulator 80, of course, will vary depending upon the cycle time of the power bucket 10' since it is desirable for the accumulator 80 to be completely pressurized whenever actuation of the hydraulic actuators 160 is required.

From the foregoing, it can be seen that the present invention provides a hydraulic power bucket assembly which is not only effective, but capable of producing a substantially level excavation during a closing cycle for the power bucket.

Having described my invention, however, many modifications thereto will become apparent to those skilled in the art to which it pertains without deviation from the spirit of the invention as defined by the scope of the appended claims.

I claim:

1. A power bucket comprising:

a first and a second swing arm, each having two spaced ends, a first end of each swing arm being pivotally secured together, a first bucket half and a second bucket half, each bucket half having a top, a bottom having cutting edge and spaced sidewalls, said first bucket half being pivotally mounted to a second end of said first swing arm and said second bucket half being pivotally mounted to a second end of said second swing arm, said bucket halves being pivotally mounted together and pivotal between an open and a closed position around a pivot connection, a first hydraulic actuator operatively connected between said first swing arm and said first bucket half, a second hydraulic actuator operatively connected between said second swing arm and said second bucket half, a source of hydraulic pressure, wherein actuation of said hydraulic actuators by selective connection with said source of hydraulic pressure pivots said bucket halves between said open and said closed position, wherein the connection of said actuators to said swing arms and said bucket halves is selected so that said cutting edges of said bucket halves move substantially along a horizontal plane and exhibit a substantially level cut as said bucket halves move between said open and said closed positions.

2. The power bucket as defined in claim 1 wherein said source of hydraulic pressure comprises a hydraulic pressure accumulator.

3. The power bucket as defined in claim 2 wherein said source of hydraulic pressure comprises a hydraulic pump having an outlet connected to said accumulator.

4. The power bucket as defined in claim 3 wherein said source of hydraulic pressure comprises an electric motor drivingly connected to said hydraulic pump.

5. The power bucket as defined in claim 1 wherein said bucket halves include facing cutting edges when said bucket halves are in said open position and wherein said pivotal connections between said swing arm, said bucket halves and said hydraulic cylinders are arranged so that, upon actuation of said cylinders, said cutting edges move in a substantially horizontal plane.

6. The power bucket as defined in claim 1 wherein said first and second hydraulic cylinders are pivotally connected to an outer surface of said first and second bucket halves, respectively.

7. The power bucket as defined in claim 1 wherein movement of said hydraulic actuators from a retracted position to an extended position pivots said bucket halves from said open to said closed position.

8. The power bucket as defined in claim 1 wherein said first hydraulic cylinder comprises a plurality of hydraulic cylinders.

9. The power bucket as defined in claim 1 wherein said second hydraulic actuator comprises a plurality of hydraulic cylinders.

10. The power bucket as defined in claim 1 wherein said pivotal connections between said swing arm, said bucket half and said hydraulic cylinder form a triangle with said hydraulic actuator forming a leg of said triangle.

11. The power bucket as defined in claim 1 wherein the pivotal connection between said first hydraulic actuator and said first bucket half is spaced outwardly from the pivotal connection between said first swing arm and said first bucket half when said bucket halves are in said closed position.

12. The power bucket as defined in claim 1 wherein the pivotal connection between said second hydraulic actuator and said second bucket half is spaced outwardly from the pivotal connection between said second swing arm and said second bucket half when said bucket halves are in said closed position.

* * * * *